US012790067B2

(12) United States Patent
Baechle

(10) Patent No.: US 12,790,067 B2
(45) Date of Patent: Nov. 10, 2026

(54) CORRUGATED CORNER POST

(71) Applicant: Sonoco Development, Inc., Hartsville, SC (US)

(72) Inventor: James R. Baechle, Gallatin, TN (US)

(73) Assignee: Sonoco Development, Inc., Hartsville, SC (US)

( * ) Notice: Subject to any disclaimer, the term of this patent is extended or adjusted under 35 U.S.C. 154(b) by 310 days.

(21) Appl. No.: 18/414,070

(22) Filed: Jan. 16, 2024

(65) Prior Publication Data

US 2025/0229940 A1 Jul. 17, 2025

(51) Int. Cl.
*B65D 5/44* (2006.01)
*B65D 5/00* (2006.01)

(52) U.S. Cl.
CPC ..... *B65D 5/445* (2013.01); *B65D 5/006* (2013.01)

(58) Field of Classification Search
CPC ..... B65D 5/445; B65D 5/006; B65D 2585/6815; B65D 81/054; B65D 75/006; B65D 61/00; B65D 5/5033; B65D 21/0215; B65D 2571/00012; B65D 2585/6855; B65D 81/54
USPC ..... 229/199; 206/453, 386, 503, 586, 320
See application file for complete search history.

(56) References Cited

U.S. PATENT DOCUMENTS 3,957,196 A * 5/1976 Kellerman ..... B65D 5/5033 206/326
4,027,814 A 6/1977 Gloge et al.
4,120,441 A 10/1978 Hurley
4,399,915 A 8/1983 Sorenson
4,714,163 A 12/1987 Reeves
6,988,615 B2 1/2006 Merkel et al.
7,913,896 B2 * 3/2011 Reinkensmeyer ..... B65D 5/445 229/199
8,333,297 B2 12/2012 Mcalpine et al.
2005/0092633 A1 * 5/2005 Baechle ..... B65D 61/00 206/320
2005/0092634 A1 * 5/2005 Baechle ..... B65D 61/00 206/320

(Continued)

FOREIGN PATENT DOCUMENTS

CN 209455196 U 10/2019
DE 202013105112 U1 12/2013

(Continued)

OTHER PUBLICATIONS

International Search Report and Written Opinion related to PCT/US2025/011136; reported on May 9, 2025.

*Primary Examiner* — Christopher R Demeree

(57) ABSTRACT

A corner post for a plastic film wrapped package include a first corner post leg and a second corner post leg that intersect at a post corner. The outer wall of the first corner post leg includes a plurality of recessed areas extending inward from an outer surface of the outer wall and are longitudinally spaced to define a plurality of ribs along the outer wall. The recessed areas and ribs are spaced so that the ribs of corner posts of adjacent packages mesh to prevent relative vertical movement of the packages. The post corner of the corner post may include longitudinally spaced recessed edge contours extending inward that grab plastic film as it is stretched or heat shrunk around the package to prevent the plastic film from sliding along the corner post.

16 Claims, 6 Drawing Sheets

(56) References Cited

U.S. PATENT DOCUMENTS

| | | | |
|---|---|---|---|
| 2022/0227559 | A1 | 7/2022 | Tsubaki |
| 2022/0289428 | A1 | 9/2022 | Moore |

FOREIGN PATENT DOCUMENTS

| | | | | |
|---|---|---|---|---|
| JP | 2004099116 | A | * | 4/2004 |
| WO | 2012126189 | A1 | | 9/2012 |
| WO | 2015101867 | A1 | | 7/2015 |

* cited by examiner

CORRUGATED CORNER POST

TECHNICAL FIELD

The present disclosure relates generally to packaging for appliances and other large products and, more particularly, to a corrugated corner post for appliance and large item packaging configured to prevent slippage of packaging film and relative vertical slippage of adjacent packages.

BACKGROUND

Major home appliances and other large products are packaged for storage and shipping in one of two ways. The outer packaging material is either a fiberboard carton or a plastic film wrapped around the product. In either type of packaging, corner protection for the product is typically provided by hollow tube corner posts, honeycomb paper, corrugated fiberboard, expanded polystyrene (EPS) foam cushions, or other similar cushioning structures. When plastic film is used to contain the product, corner cushioning structures are applied at the four corners of the product to protect the corners against damage from impacts. These corner structures may also assist in supporting package stacking in the distribution environment. The plastic film is wrapped around the product and the cushioning structure to hold the product closed and to hold the cushioning structures against the vertical corners of the product. The plastic film is typically either a shrink wrap film or a stretch wrap film. Shrink wrap film is loosely applied around the product and heat is applied to shrink the film tightly against the sides of the product and partially capturing the bottom and top of the product to prevent the film and cushioning structures from sliding along the corners of the product. Stretch wrap film is stretchable and is wrapped around the product and cushioning structures tightly so that tension in the film holds the cushioning structures against the corners of the product.

Currently-known paper-based cushioning structures and hollow cushioning structures can present issues in storage and transport of the products. Because paper-based cushioning structures are linear and smooth, plastic films used as the packaging tend to slip when the packaging is handled through the distribution network. The slippage can cause the bottom capture to be compromised and allow the product to fall out the bottom. The smoothness also allows slipping between packages during multiple product handling. Hollow cushioning structures can potentially yield under the forces applied by the film wrap and collapse. The horizontal tension applied by stretch wraps can tend to roll and collapse the hollow structures around the corners. As the geometry of the hollow structures changes during distribution, the film wraps loosen, thereby allowing slippage between the product and the cushioning structures.

SUMMARY OF THE DISCLOSURE

In one aspect of the present disclosure, a corner post for a plastic film wrapped package for a product is disclosed. The corner post may be fabricated from a paperboard blank and may include a first corner post leg having a first leg inner wall and a first leg outer wall, and a second corner post leg having a second leg inner wall and a second leg outer wall, wherein the first corner post leg and the second corner post leg intersect at a post corner. The first leg outer wall may include a plurality of recessed areas extending inward from an outer surface of the first leg outer wall, wherein the plurality of recessed areas may be spaced in a longitudinal direction of the corner post to define a plurality of ribs spaced in the longitudinal direction along the first leg outer wall, and the plurality of recessed areas may extend to a first post leg edge that is opposite the post corner.

In another aspect of the present disclosure, a corner post for a plastic film wrapped package for a products is disclosed. The corner post may include a corner post blank fabricated from a paperboard sheet and having a longitudinal direction and a transverse direction that is perpendicular to the longitudinal direction, a plurality of fold lines in the longitudinal direction dividing the corner post blank into a plurality of walls of the corner post, and a row of recessed area cutout portions through the corner post blank in a first leg outer wall that are spaced in the longitudinal direction to define a plurality of ribs of the first leg outer wall. When the corner post blank is folded about the plurality of fold lines to form the corner post having a first corner post leg and a second corner post leg intersecting at a post corner, the recessed area cutout portions may define a plurality of recessed areas extending inward from an outer surface of the first leg outer wall and separated by the plurality of ribs.

In a further aspect of the present disclosure, a corner post for a plastic film wrapped package for a product is disclosed. The corner post may be fabricated from a paperboard blank and may include a first corner post leg having a first leg inner wall and a first leg outer wall, a second corner post leg having a second leg inner wall and a second leg outer wall, wherein the first corner post leg and the second corner post leg intersect at a post corner, and a plurality of recessed edge contours disposed at the post corner and extending inward from an outer surface of the first leg outer wall and an outer surface of the second leg outer wall. The plurality of recessed edge contours may be spaced in the longitudinal direction of the corner post.

Additional aspects are defined by the claims of this patent.

DETAILED DESCRIPTION

Figure 1:
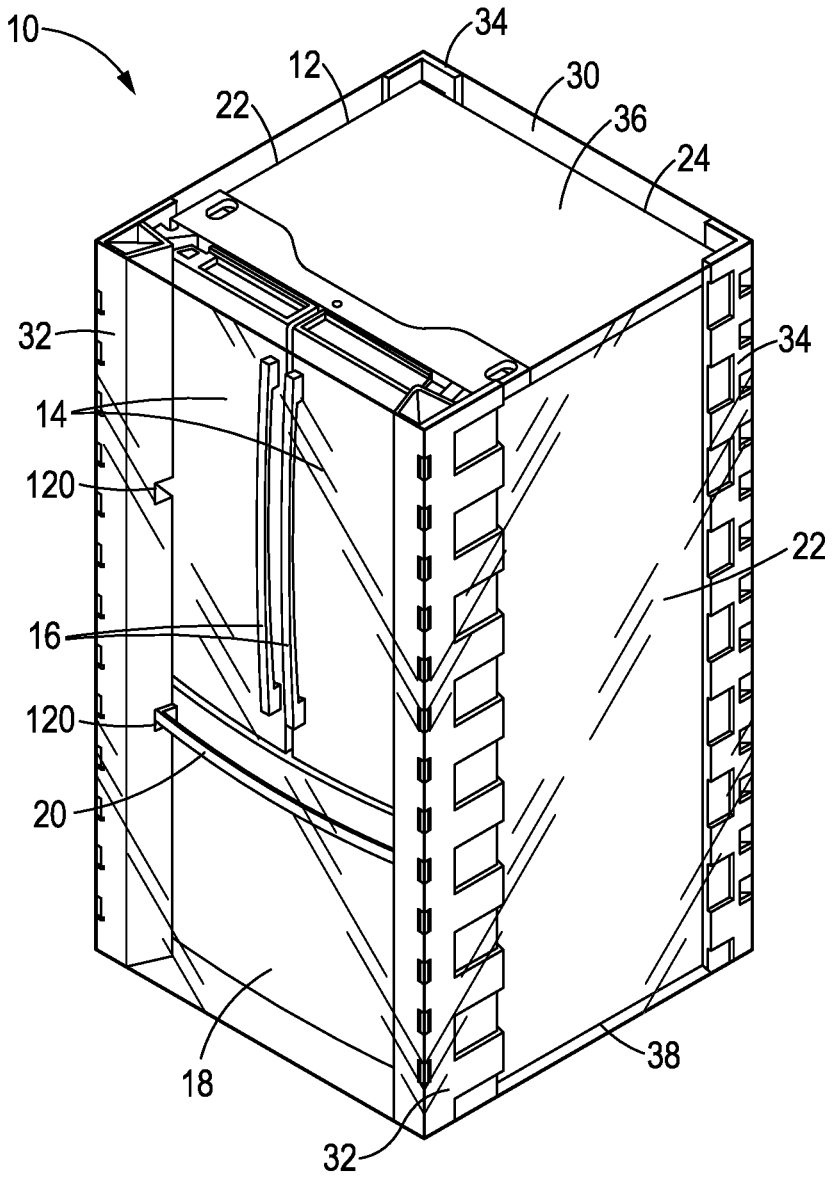
FIG. 1 is an isometric view of a plastic film wrapped package for a large product having corner posts in accordance with the present disclosure.

FIG. 1 illustrates an exemplary package 10 for a large item or product 12 such as a large appliance. In this example, the product 12 is a refrigerator having upper doors 14 with vertical handles 16 and a pull-out freezer door 18 with a horizontal handle 20 with ends proximate side walls 22 of the refrigerator 12. A rear wall 24 of the refrigerator 12 may be flat or have components such as power cords, water lines, radiator assemblies, screw heads and the like disposed rearward of the rear wall 24.

The package 10 for the product 12 is formed by a plastic film 30, a pair of front corner posts 32, and a pair of rear corner posts 34. The plastic film 30 may be a shrink wrap film or a stretch film that tightly wraps around the product 12 and the corner posts 32, 34 to tightly hold the corner posts 32, 34 against the corresponding vertical corners of the product 12. The plastic film 30 may be extended above the top edges of the corner posts 32, 34 to partially or fully capture the top wall 36 of the product 12 and/or below bottom edges of the corner posts 32, 34 to partially capture a bottom wall 38 of the product 12, and thereby prevent the plastic film 30 and the corner posts 32, 34 from sliding along the corners of the product 12.

Figure 2:
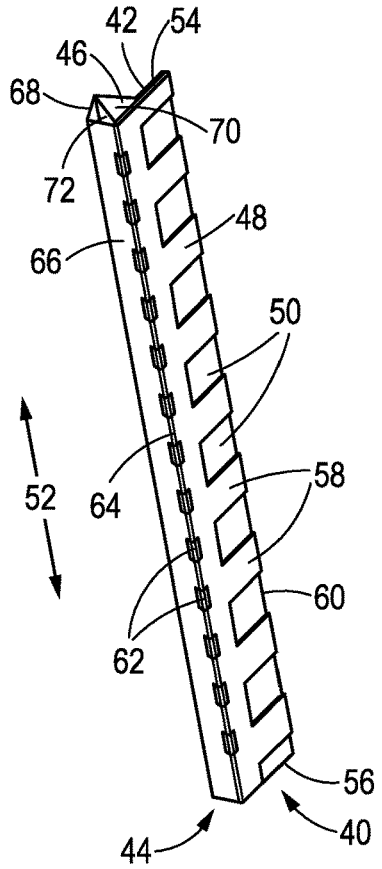
FIG. 2 is an isometric view of a front corner post in accordance with the present disclosure of the plastic film wrapped package of FIG. 1.

FIG. 2 illustrates an embodiment of the front corner post 32 in accordance with the present disclosure configured to prevent slippage of the plastic film 30 along the front corner post 32 and slippage of adjacent packages 10 during transport. The front corner post 32 may be generally L-shaped to fit around the corresponding front corner of the product 12. A first corner post leg 40 of the front corner post 32 may have a first leg inner wall 42 that faces and engages the corresponding side wall 22 of the product 12 and sides of the doors 14, 18. A second corner post leg 44 of the front corner post 32 may have a second leg inner wall 46 that faces and engages the front walls of the doors 14, 18 when the front corner post 32 is installed. The leg inner walls 42, 46 may intersect at a corner post corner 64 and form an inner corner angle therebetween that is complimentary to an angle at the corresponding corner of the product 12 so that the leg inner walls 42, 46 are pressed against the surfaces of the product 12 when the plastic film 30 is applied.

The first corner post leg 40 may have a first leg outer wall 48 opposite the first leg inner wall 42 and facing away from the side wall 22 of the product 12. The first leg outer wall 48 may include cut-out or recessed areas 50 spaced along the first leg outer wall 48 in a longitudinal direction indicated by an arrow 52 from a first post end edge 54 to a second post end edge 56. The recessed areas 50 extend inward from an outer surface of the first leg outer wall 48. The alternating recessed areas 50 in the first leg outer wall 48 define a plurality of alternating ribs 58 of the first leg outer wall 48 that may extend to a first post leg edge 60. In alternative embodiments, the recessed areas 50 may also extend to the corner post corner 64

Figure 3:
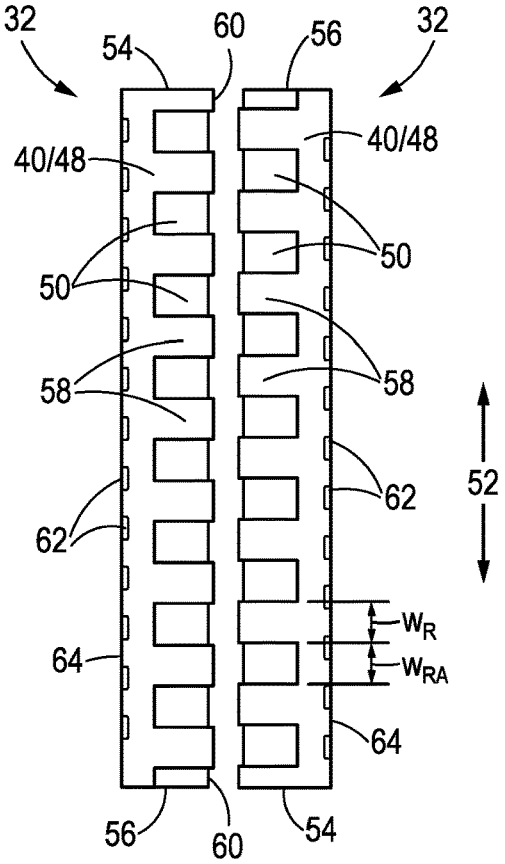
FIG. 3 is a side view of an adjacent pair of the front corner posts of FIG. 2.

As shown in FIG. 3, the ribs 58 may be staggered so that a common front corner post 32 may be used on both sides of the product 12. The front corner posts 32 may be flipped or rotated 180° relative to each other about an axis perpendicular to the longitudinal direction 52 so that the ribs 58 of a left front corner post 32 of one package 10 align with the recessed areas 50 of the right front corner post 32, and vice versa, when the first post end edge 54 of one front corner post 32 is longitudinally aligned with the second post end edge 56 of the other front corner post 32. The ribs 58 may have a rib width $w_R$ that is equal to or slightly less than a recessed area width $w_{RA}$ of the recessed areas 50. With this arrangement, the ribs 58 of the adjacent front corner posts 32 can mesh and engage to prevent the adjacent packages 10 from sliding vertically relative to each other when pressed together and lifted by a clamp forklift.

The first leg outer wall 48 may further include recessed edge contours 62 at the corner post corner 64 where the first leg outer wall 48 intersects a second leg outer wall 66. The recessed edge contours 62 may extend around the corner post corner 64 to the second leg outer wall 66, and may be longitudinally spaced along the corner post corner 64. The recessed edge contours 62 may be shaped in terms of length and depth to grab the plastic film 30 as it is stretched or heat shrunk around the package 10 to prevent the plastic film 30 from sliding along the front corner posts 32.

The front corner post 32 may be further configured to accommodate the forward extension of the door handles 16, 20 from the doors 14, 18. The second leg outer wall 66 may be spaced forward of the second leg inner wall 46 by a distance so that the door handles 16, 20 to not extend forward beyond the second leg outer wall 66. A second leg intermediate wall 68 may extend between edges of the second leg inner wall 46 and the second leg outer wall 66 opposite the second corner post leg 44 and define a second leg cavity 70. To prevent the second leg cavity 70 from collapsing under the tension of the plastic film 30, a second leg support wall 72 may be provided within the second leg cavity 70 and extend between opposite corners of the second leg cavity 70 to bisect the second leg cavity 70 into two triangles. The size of the second leg cavity 70 may vary based on the size of the structures extending from the product 12.

Figure 4:
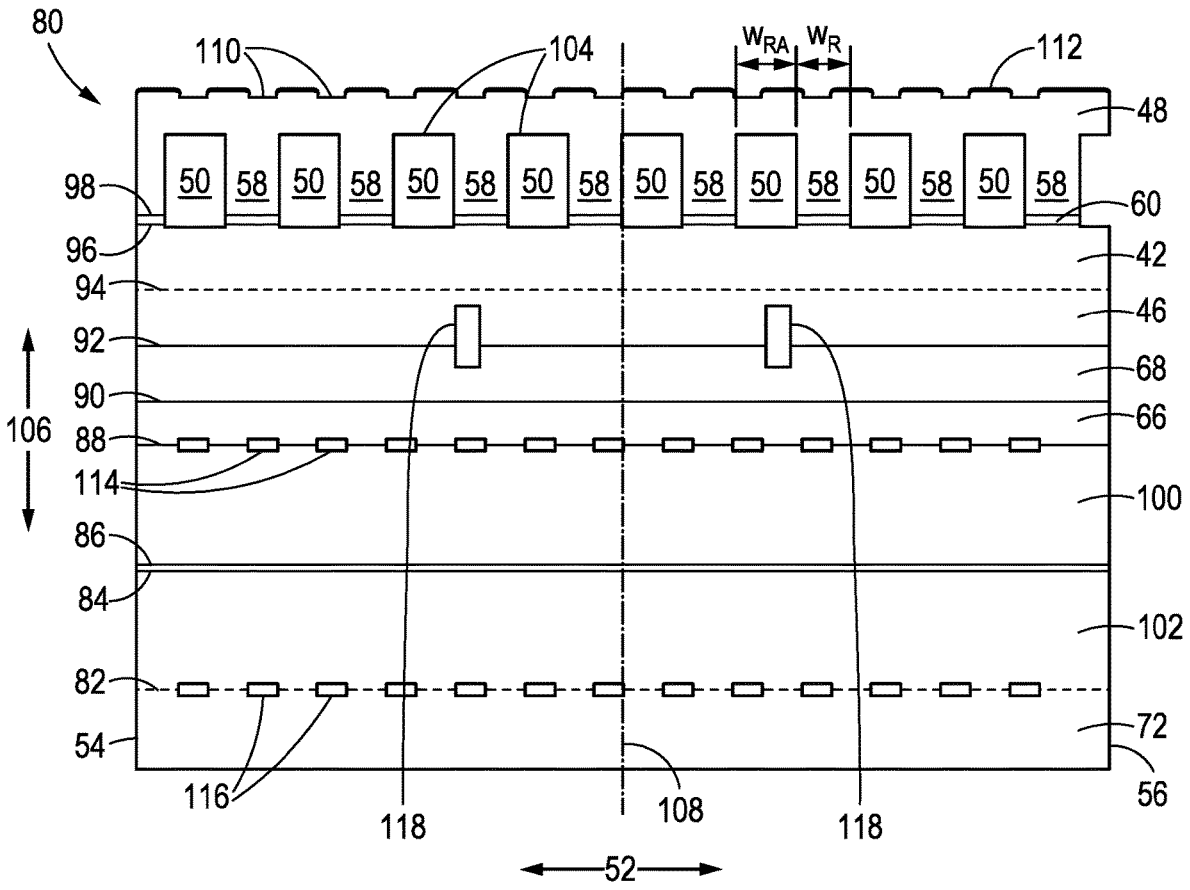
FIG. 4 is a plan view of a front corner post blank in accordance with the present disclosure from which the front corner post of FIG. 2 may be formed.

FIG. 4 illustrates an embodiment of a front corner post blank 80 from which the front corner post 32 may be formed. The front corner post blank 80 may be a standard corrugated cardboard sheet having at least one fluted sheet between two liner sheets. In alternative embodiments, the front corner post blank 80 may be formed from other types of paperboard sheets that may be folded into the front corner post 32 in accordance with the present disclosure. The front corner post blank 80 is subdivided by longitudinal fold lines or creases 82-98 that separate the blank 80 into the walls 42, 46, 48, 66, 68, 72 as well as first leg interior walls 100, 102 of the front corner post 32. Adjacent walls 42, 46, 48, 66, 68, 72, 100, 102 will be folded around the corresponding fold lines 82-98 to form the front corner post 32 as discussed further below. In this embodiment, the fold lines 82, 94 are shown as dashed lines to indicate that the blank 80 will be folded about the fold lines 82, 94 in the opposite direction as the remaining fold lines 84-92, 96, 98 when the front corner post 32 is formed.

The blank 80 is fabricated with cutout portions removed by die cuts or other forms of cutting to form the recessed areas 50 and ribs 58, the recessed edge contours 62 and other features of the front corner post 32. A first set of recessed area cutout portions 104 form the recessed areas 50 in the first leg outer wall 48. The recessed area cutout portions 104 begin within the first leg outer wall 48 and extend in a transverse direction (arrow 106) that is perpendicular to the longitudinal direction 52. The recessed area cutout portions 104 extend past the fold lines 96, 98 that separate the walls 42, 48 and define the rear edge 60 of the front corner post 32. Extending the recessed area cutout portions 104 across the fold lines 96, 98 extends the recessed areas 50 and the ribs 58 to the rear edge 60 so that the recessed areas 50 can receive the ribs 58 of the front corner post 32 of an adjacent package 10 and the ribs 58 of the front corner posts 32 can mesh and interlock as discussed above.

To align the recessed areas 50 of the left front corner post 32 of one package 10 with the ribs 58 of the right front corner post 32 of an adjacent package 10, and vice versa, the recessed area cutout portions 104 are not arranged symmetrically relative to a longitudinal centerline 108 of the front corner post blank 80 and, correspondingly, the front corner post 32. As shown in FIG. 4, the recessed area cutout portions 104 may be offset in one direction by approximately one-half the recessed area width $w_{RA}$. With this offset, the recessed areas 50 and the ribs 58 align as shown in FIG. 3 when one front corner post 32 is rotated 180° relative to the other front corner post 32.

The recessed edge contours 62 may be formed through multiple walls of the front corner post 32 to provide depth to firmly engage and grab the plastic film 30 to prevent slippage. A series of partial contour cutout portions 110 may be made along a corner edge 112 of the front corner post blank 80 at the first leg outer wall 48. The partial contour cutout portions 110 are longitudinally spaced and may have a depth inward from the corner edge 112 in the transverse direction 106 that is approximately half a transverse depth of contour cutout portions 114, 116 made along the fold lines 82, 88, respectively. The contour cutout portions 108, 114, 116 are longitudinally spaced so that contour cutout portions 108, 114, 116 at the same longitudinal position along the front corner post blank 80 are stacked to form each of the recessed edge contours 62.

Additional cutout portions may be provided in the front corner post blank 80 to accommodate product features extending forward from the front surface of the product 12 proximate the corners at which the front corner posts 32 are located. For example, handle cutout portions 118 may be made in the second leg inner wall 46 and the second leg intermediate wall 68, and across the fold line 92, to form handle openings 120 in the second corner post leg 44. As shown in FIG. 1, a lower one of the handle openings 120 of the left front corner post 32 may receive a left end of the horizontal handle 20 of the freezer door 18. On the right front corner post 32, which has been flipped 180° relative to the left front corner post 32, the other handle opening 120 is the lower one that receives the right end of the horizontal handle 20.

Figure 5:
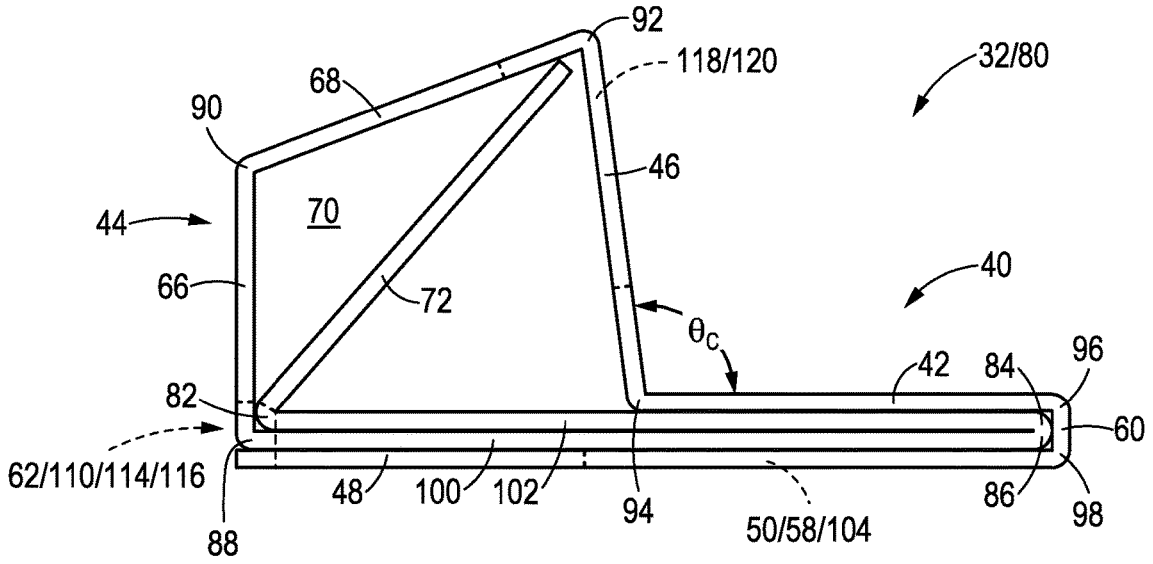
FIG. 5 is an end view of the front corner post of FIG. 2 formed from the front corner post blank of FIG. 4.

FIG. 5 illustrates the front corner post blank 80 folded along the fold lines 82-98 to form the front corner post 32. From the perspective shown in the drawing figure, formation of the front corner post 32 from the front corner post blank 80 may begin by folding the first leg interior wall 102 about the fold line 82 toward the second leg support wall 72 in the counterclockwise direction. Subsequently, the adjacent walls at the fold lines 84-92 may be folded clockwise about the fold lines 84-92 to form the interior of the first corner post leg 40 from first leg interior walls 100, 102 and the second corner post leg 44 from walls 46, 66, 68 with the second leg support wall 72 positioned within the second leg cavity 70. The first leg inner wall 42 is folded counterclockwise about the fold line 94 toward the second leg inner wall 46, and clockwise folds are made about the fold lines 96, 98 to form the first post leg edge 60 and dispose the first leg interior walls 100, 102 between the first leg inner wall 42 and the first leg outer wall 48.

The front corner post blank 80 is configured so that the front corner post 32 has a complimentary shape to the corresponding front corner of the product 12. The walls 42, 46, 48, 66, 68, 72, 100, 102 are dimensioned so that an inner corner angle $\theta_C$ matches the outer corner angle of the product 12 so that the leg inner walls 42, 46 engage the surfaces of the product 12 when the plastic film 30 applies tension to the front corner posts 32. Additionally, hidden lines on the second leg inner wall 46 and the second leg intermediate wall 68 indicate the locations of the handle cutout portions 118 forming the handle openings 120 for receiving the ends of the horizontal handle 20. If necessary cutouts may be formed in the second leg support wall 72 at the longitudinal positions of the handle cutout portions 118 to allow insertion of the horizontal handle 20 while allowing the second leg support wall 72 to support the second corner post leg 44 at the fold line 92.

The front corner post blank 80 is further configured to form the exterior features preventing slippage between adjacent packages 10 and between the plastic film 30 and the front corner posts 32. Hidden lines on the first leg outer wall 48 indicate the location of the recessed area cutout portions 104 to form the recessed areas 50 and the ribs 58 and extension thereof through the first post leg edge 60. Additional hidden lines in the walls 48, 66, 72, 100, 102 indicate the partial contour cutout portion 110 and the contour cutout portions 114, 116 that align at the post corner 64 to form the recessed edge contours 62 of the front corner post 32 that will grab the plastic film 30.

Figure 6:
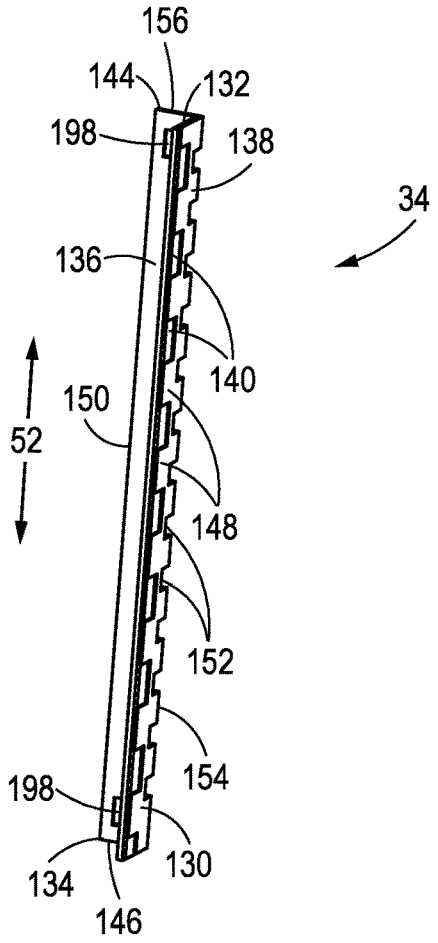
FIG. 6 is an isometric view of a rear corner post in accordance with the present disclosure of the plastic film wrapped package of FIG. 1.

The rear corner posts 34 may have similar features as the front corner posts 32 to prevent slippage of the plastic film 30 and adjacent packages 10 during transport. FIG. 6 illustrates an embodiment of the rear corner post 34. The rear corner post 34 may be generally L-shaped to fit around the corresponding rear corner of the product 12. A first corner post leg 130 of the rear corner post 34 may have a first leg inner wall 132 that faces and engages the corresponding side wall 22 of the product 12. A second corner post leg 134 of the rear front corner post 34 may have a second leg inner wall 136 that faces and engages the rear wall 24 of the product 12 when the rear corner post 34 is installed. The leg inner walls 132, 136 may intersect and form an inner corner angle that is complimentary to an angle at the corresponding corner of the product 12 so that the leg inner walls 132, 136 are pressed against the surfaces of the product 12 when the plastic film 30 is applied.

Figure 7:
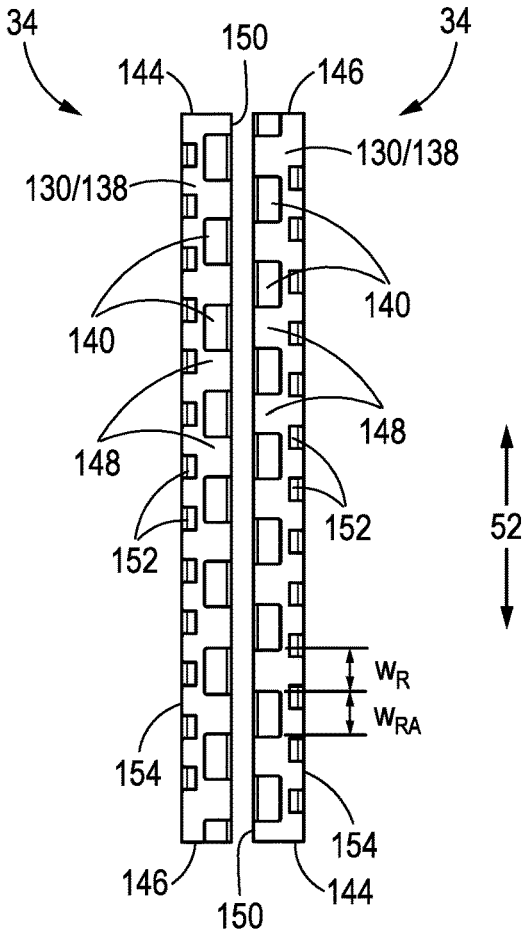
FIG. 7 is a side view of an adjacent pair of the rear corner posts of FIG. 6.

The first corner post leg 130 may have a first leg outer wall 138 opposite the first leg inner wall 42 and facing away from the side wall 22 of the product 12. The first leg outer wall 138 may include cut-out or recessed areas 140 similar to the recessed areas 50 spaced along the first leg outer wall 138 in the longitudinal direction 52 from a first post end edge 144 to a second post end edge 146. The alternating recessed areas 140 in the first leg outer wall 138 define a plurality of alternating ribs 148 of the first leg outer wall 138 that may extend to a first post leg edge 150. As shown in FIG. 7, the ribs 148 may be staggered so that two rear corner posts 34 may be flipped 180° relative to each other so that the recessed areas 140 and the ribs 148 of the rear corner post 34 of adjacent packages 10 align as described above, and the ribs 148 of the adjacent rear corner posts 34 can mesh and engage to prevent the adjacent packages 10 from sliding vertically relative to each other when pressed together and lifted by a clamp forklift.

The first leg outer wall 138 may further include recessed edge contours 152 at a corner post corner 154 where the first leg outer wall 138 intersects a second leg outer wall 156. The recessed edge contours 152 may extend around the corner post corner 154 to the second leg outer wall 156, and may be longitudinally spaced along the rear corner post corner 154. The recessed edge contours 152 may be shaped in terms of length and depth to grab the plastic film 30 as it is stretched or heat shrunk around the package 10 to prevent the plastic film 30 from sliding along the rear corner posts 34.

In the illustrated embodiment, the product 12 does not have components extending a substantial distance rearward from the rear wall 24. Consequently, the second corner post leg 134 may not need to be constructed in a similar manner as the second corner post leg 44 by having the second leg outer wall 156 spaced from the second leg inner wall 136. However, if necessary, embodiments of the rear corner post 34 may have the second leg walls 136, 156 spaced and additional structures similar to the walls 68, 72 may be provided to provide spacing while resisting collapsing under the tension of the plastic film 30.

Figure 8:
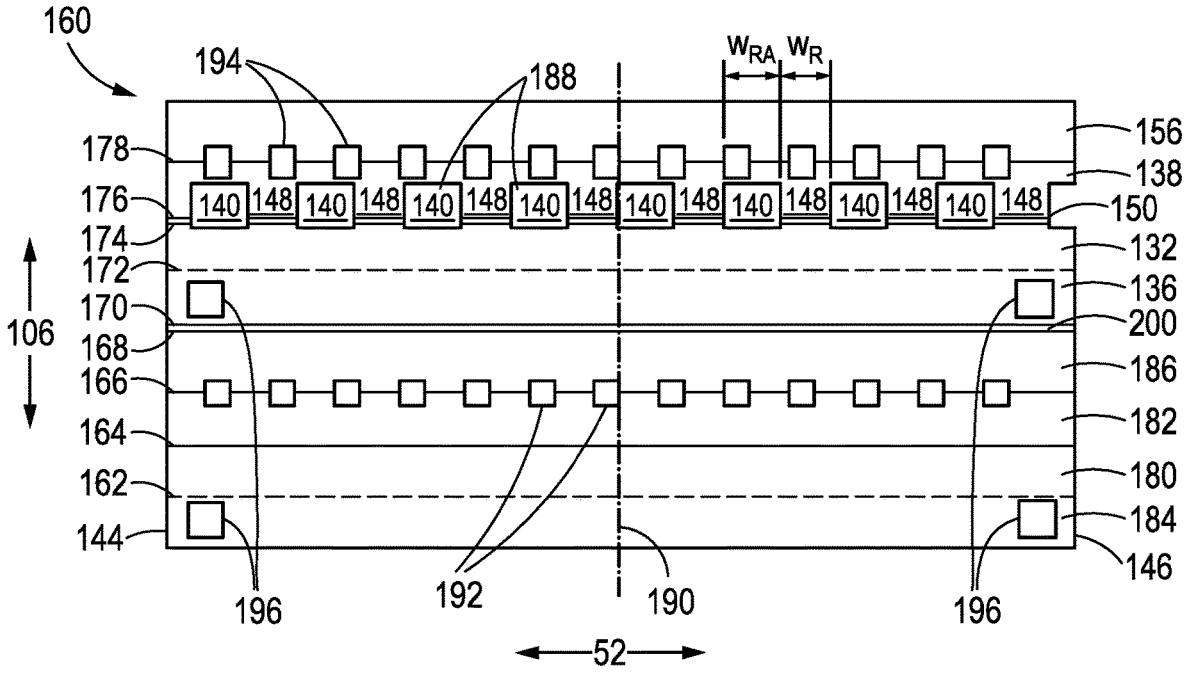
FIG. 8 is a plan view of a rear corner post blank in accordance with the present disclosure from which the rear corner post of FIG. 6 may be formed.

FIG. 8 illustrates an embodiment of a rear corner post blank 160 from which the rear corner post 34 may be formed. The rear corner post blank 160 may be a standard corrugated cardboard sheet having at least on fluted sheet between two liner sheets. In alternative embodiments, the rear corner post blank 160 may be formed from other types of paperboard sheets that may be folded into the rear corner post 34 in accordance with the present disclosure. The rear corner post blank 160 is subdivided by longitudinal fold lines or creases 162-178 that separate the blank 160 into the walls 132, 136, 138, 156 as well as first leg interior walls 180, 182 and second leg interior walls 184, 186 of the rear corner post 34. Adjacent walls 132, 136, 138, 156, 180-186 will be folded around the corresponding fold lines 162-178 to form the rear corner post 34 as discussed further below. The fold lines 162, 172 are shown as dashed lines to indicate that the blank 160 will be folded about the fold lines 162, 172 in the opposite direction as the remaining fold lines 164-170, 174-178 when the rear corner post 34 is formed.

The rear corner post blank 160 is fabricated with cutout portions removed by die cuts or other forms of cutting to form the recessed areas 140 and the ribs 148, the recessed edge contours 152 and other features of the rear corner post 34. A first set of recessed area cutout portions 188 form the recessed areas 140 in the first leg outer wall 138. The recessed area cutout portions 188 begin within the first leg outer wall 138 and extend in the transverse direction 106. The recessed area cutout portions 188 extend past the fold lines 174, 176 that separate the walls 132, 138 and define the front edge 150 of the rear corner post 34. Extending the recessed area cutout portions 188 across the fold lines 174, 176 extends the recessed areas 140 and the ribs 148 to the first post leg edge 150 so that the recessed areas 140 can receive the ribs 148 of the rear corner post 34 of an adjacent package 10 and the ribs 148 of the rear corner posts 34 can mesh and interlock as discussed above.

To align the recessed areas 140 of the left rear corner post 34 of one package 10 with the ribs 148 of the right rear corner post 34 of an adjacent package 10, and vice versa, the recessed area cutout portions 188 are not arranged symmetrically relative to a longitudinal centerline 190 of the rear corner post blank 160 and, correspondingly, the rear corner post 34. As shown in FIG. 8, the recessed area cutout portions 188 are offset in one direction by approximately one-half the recessed area width $w_{RA}$. With this offset, the recessed areas 140 and the ribs 148 align as shown in FIG. 7 when one rear corner post 34 is rotated 180° relative to the other rear corner post 34.

The recessed edge contours 152 may be formed through multiple walls of the rear corner post 34 to provide depth to firmly engage and grab the plastic film 30 to prevent slippage. A series of contour cutout portions 192, 194 may be made along the fold lines 166, 178, respectively, and are longitudinally spaced across the blank 160. The contour cutout portions 192, 194 are longitudinally spaced so that contour cutout portions 192, 194 at the same longitudinal position along the rear corner post blank 160 are stacked to form each of the recessed edge contours 152. Additional cutout portions may be provided in the rear corner post blank 160 to accommodate product features extending rearward from the rear surface of the product 12 proximate the edges at which the rear corner posts 34 are located. For example, screw head cutout portions 196 may be made in the second leg inner wall 136 and the second leg interior wall 184 to form screw head openings 198 in the second corner post leg 134 (FIG. 6). The screw head openings 198 of the rear corner posts 34 may receive screw heads of screws (not shown) that fasten the rear wall 24 to a frame of the product 12 to enclose internal components.

Figure 9:
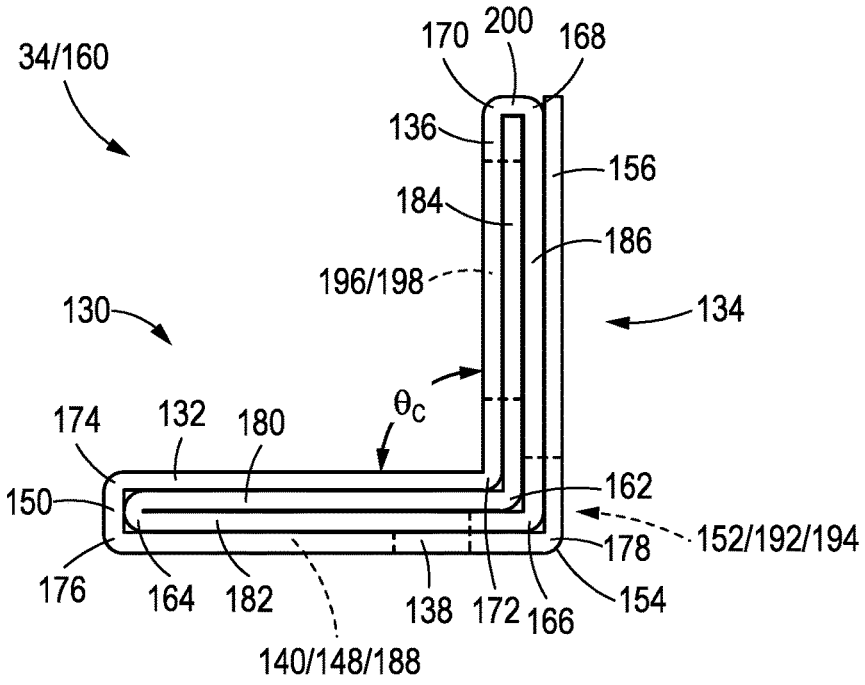
FIG. 9 is an end view of the rear corner post of FIG. 6 formed from the rear corner post blank of FIG. 8.

FIG. 9 illustrates the rear corner post blank 160 folded along the fold lines 162-178 to form the rear corner post 34. As shown in the drawing figure, formation of the rear corner post 34 from the rear corner post blank 160 may begin by folding the first leg interior wall 180 about the fold line 162 toward the second leg interior wall 184 in the clockwise direction. Subsequently, the adjacent walls at the fold lines 164-168 may be folded counterclockwise about the fold lines 164-168 to form the interior of the side leg 130 from first leg interior walls 180, 182 and the interior of the rear leg 134 from the second leg interior walls 184, 186. Folding the second leg inner wall 136 counterclockwise about the fold line 170 forms a second post leg edge 200 of the rear corner post 34. The first leg inner wall 132 is folded clockwise about the fold line 172 to form the inner corner angle $\theta_C$ that is complimentary to the outer corner angle of the rear corners of the product 12 so that the leg inner walls 132, 136 engage the surfaces of the walls 22, 24, respectively. Counterclockwise folds are made about the fold lines 174-178 to form the first post leg edge 150 and dispose the first leg interior walls 180, 182 between the first leg inner wall 132 and the first leg outer wall 138 and the second leg interior walls 184, 186 between the second leg inner wall 136 and the second leg outer wall 156.

Hidden lines on the first leg outer wall 138 indicate the location of the recessed area cutout portions 188 to form the recessed areas 140 and the ribs 148 and extension thereof through the first post leg edge 150. Hidden lines in the walls 138, 156, 182, 186 indicate the contour cutout portions 192, 194 that align at the corner post corner 154 to form the recessed edge contours 152 of the rear corner post 34 that will grab the plastic film 30. Additional hidden lines on the second leg inner wall 136 and the second leg interior wall 184 indicate the locations of the screw head cutout portions 196 forming the screw head openings 198 for receiving the screw head on the rear wall 24.

INDUSTRIAL APPLICABILITY

The corner posts 32, 34 in accordance with the present disclosure may provide improved reliability in plastic film wrapped packaging for large appliances and other products. The recessed edge contours 62, 152 provide discontinuity along the corner post corners 64, 154 that disrupts the smoothness found in previous corner posts. When the plastic film 30 is stretched or shrunk around the package 10, the plastic film 30 sinks into and is grabbed by the recessed edge contours 62, 152. The tension in the plastic film 30 may prevent the portions disposed within the recessed edge contours 62, 152 from being easily pulled out of the recessed edge contours 62, 152 during storage and transport so that the plastic film 30 does not slide in the longitudinal direction 52 along the corner posts 32, 34.

Figure 10:
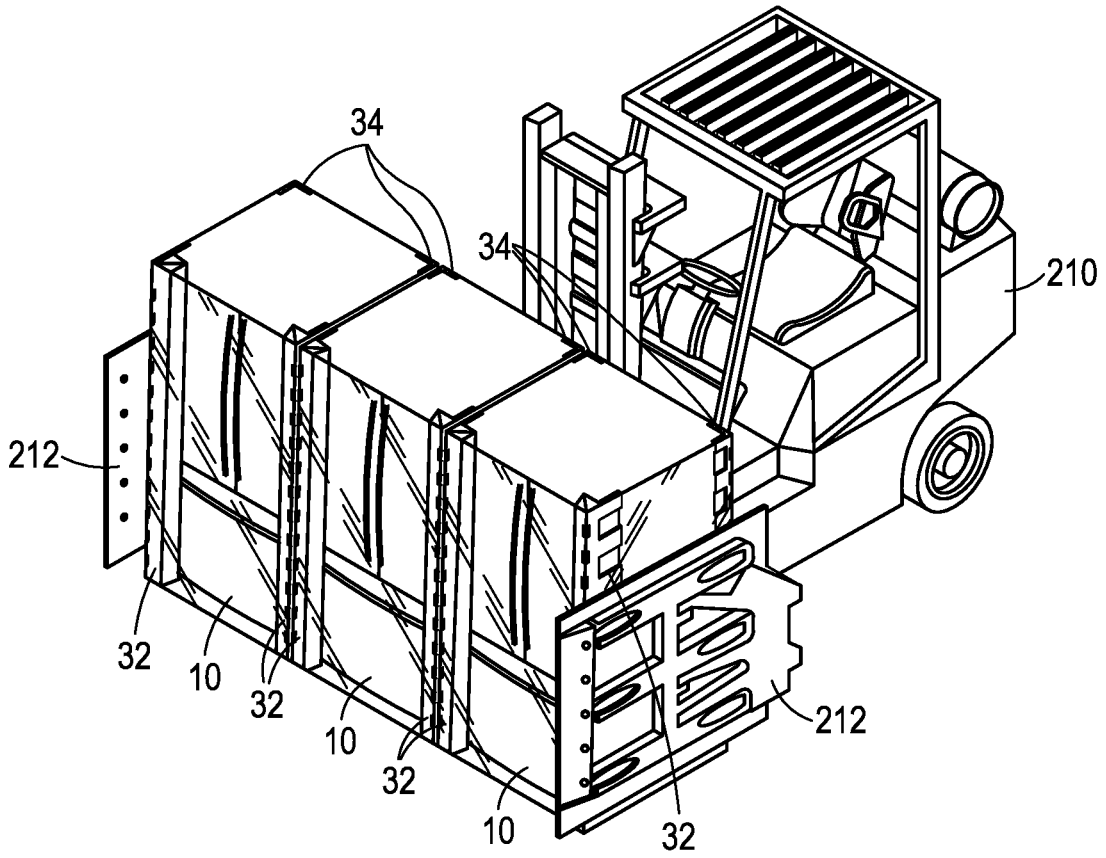
FIG. 10 is an isometric view of a clamp forklift engaging three adjacent plastic film wrapped packages of FIG. 1.

The corner posts 32, 34 in accordance with the present disclosure also may prevent slippage between adjacent packages 10 during transport by material handling equipment. To increase productivity on loading docks and in warehouses, multiple packages 10 may be handled by the material handling equipment at the same time. Due to the size of the products 12, it may be most efficient to handle the packages 10 when they are side-by-side. FIG. 10 illustrates an example of a clamp forklift 210 that may include right and left clamp plates 212 to grab and lift the packages 10 so that the clamp forklift 210 can drive the packages 10 to another location. In previous plastic film wrapped packages, the center package may tend to slip relative to the other packages when the clamp forklift 210 lifts the packages due to the smooth sides of the corner posts, the packages may drop, and the products 12 may be damaged. Conversely, in packages 10 with the corner posts 32, 34, the ribs 58, 148 of adjacent corner posts 32, 34 mesh to prevent slippage of the adjacent packages 10.

The corner posts 32, 34 in accordance with the present disclosure are also resistant to collapsing or rolling under the tension from the plastic film 30 as can happen with previous hollow corner posts. The corner post legs 40, 130, 134 are formed by stacked cardboard plies with no gaps to collapse upon. Hollow legs such as the second corner post leg 44 may have separation between inner and outer walls 46, 66 and form the second leg cavity 70. However, structure such as the second leg support wall 72 reinforce the second corner post leg 44 to prevent collapse from tension in the direction of the product 12 and from horizontal tension tending to roll the corner post 32 around the corner of the product 12.

The corner posts 32, 34 in accordance with the present disclosure may provide benefits in addition to the structural benefits when used in the package 10. The paperboard from which the corner posts 32, 34 are fabricated may be a sustainable material that can be recycled and reused in other products. Additionally, the design of the corner posts 32, 34 may facilitate manufacturing and inventory management. As discussed, pairs of identical front corner posts 32 and rear corner posts 34 can be used on the left and right sides of the package 10 by flipping one of each pair 180°. The recessed areas 50 and the ribs 58 are positioned to align and mesh when adjacent packages 10 are pressed together. With this design, only a single blank, part number and fabrication process are required to make the front corner posts 32 or rear corner posts 34 for both sides of the package 10.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A corner post for a plastic film wrapped package for a product, wherein the corner post is fabricated from a paperboard blank, the corner post comprising:

a first corner post leg having a first leg inner wall a first leg outer wall;

a second corner post leg having a second leg inner wall and a second leg outer wall, wherein the first corner post leg and the second corner post leg intersect at a post corner;

a first post end edge at a first longitudinal end of the corner post; and a second post end edge at a second longitudinal end of the corner post that is longitudinally opposite the first longitudinal end, wherein the first leg outer wall comprises a plurality of recessed areas extending inward from an outer surface of the first leg outer wall, wherein the plurality of recessed areas are spaced in a longitudinal direction of the corner post to define a plurality of ribs spaced in the longitudinal direction along the first leg outer wall, and wherein the plurality of recessed areas extend to a first post leg edge that is opposite the post corner, and where the plurality of recessed areas and the plurality of ribs are positioned along the first leg outer wall such that, when the corner post is aligned with an adjacent corner post with the first post end edge of the corner post longitudinally aligned with the second post end edge of the adjacent corner post, the second post end edge of the corner post longitudinally aligned with the first post end edge of the adjacent corner post and the first leg outer wall of the corner post facing the first leg outer wall of the adjacent corner post, the plurality of recessed areas of the corner post are longitudinally aligned with the plurality of ribs of the adjacent corner post and the plurality of ribs of the corner post are longitudinally aligned with the plurality of recessed areas of the adjacent corner post so that the plurality of ribs of the corner post and the plurality of ribs of the adjacent corner post mesh and interlock when the corner post and the adjacent corner post are pressed together.

2. The corner post of claim 1, wherein the first corner post leg comprises a first leg interior wall disposed between the first leg inner wall and the first leg outer wall.

3. The corner post of claim 1, comprising a plurality of recessed edge contours disposed at the post corner and extending inward from the outer surface of the first leg outer wall and an outer surface of the second leg outer wall, wherein the plurality of recessed edge contours are spaced in the longitudinal direction of the corner post.

4. The corner post of claim 3, wherein the first corner post leg comprises a first leg interior wall disposed between the first leg inner wall and the first leg outer wall, wherein the second corner post leg comprises a second leg interior wall disposed between the second leg inner wall and the second leg outer wall, and wherein the plurality of recessed edge contours extend inward through the first leg interior wall and the second leg interior wall.

5. The corner post of claim 1, wherein the second leg outer wall is spaced from the second leg inner wall, wherein the second corner post leg comprises a second leg intermediate wall extending between an inner wall edge of the second leg inner wall opposite the post corner and an outer wall edge of the second leg outer wall opposite the post corner to define a second leg cavity.

6. The corner post of claim 5, wherein the second corner post leg comprises a second leg support wall extending from the post corner to an intersection of the second leg inner wall and the second leg intermediate wall.

7. A corner post for a plastic film wrapped package for a product, wherein the corner post is fabricated from a paperboard blank, the corner post comprising:

a first corner post leg having a first leg inner wall and a first leg outer wall; and a second corner post leg having a second leg inner wall and a second leg outer wall, wherein the first corner post leg and the second corner post leg intersect at a post corner, wherein the first leg outer wall comprises a plurality of recessed areas extending inward from an outer surface of the first leg outer wall, wherein the plurality of recessed areas are spaced in a longitudinal direction of the corner post to define a plurality of ribs spaced in the longitudinal direction along the first leg outer wall, wherein the plurality of recessed areas extend to a first post leg edge that is opposite the post corner, and wherein each of the plurality of recessed areas has a recessed area width and each of the plurality of ribs has a rib width that is less than or equal to the recessed area width.

8. A corner post for a plastic film wrapped package for a products, comprising:

a corner post blank fabricated from a paperboard sheet and having a longitudinal direction and a transverse direction that is perpendicular to the longitudinal direction;

a plurality of fold lines in the longitudinal direction dividing the corner post blank into a plurality of walls of the corner post;

a row of recessed area cutout portions through the corner post blank in a first leg outer wall that are spaced in the longitudinal direction to define a plurality of ribs of the first leg outer wall, wherein, when the corner post blank is folded about the plurality of fold lines to form the corner post having a first corner post leg and a second corner post leg intersecting at a post corner, the recessed area cutout portions define a plurality of recessed areas extending inward from an outer surface of the first leg outer wall and separated by the plurality of ribs;

a first post end edge at a first longitudinal end of the corner post; and a second post end edge at a second longitudinal end of the corner post that is longitudinally opposite the first longitudinal end, where the plurality of recessed area cutout portions are positioned along the first leg outer wall such that, when the corner post is aligned with an adjacent corner post with the first post end edge of the corner post longitudinally aligned with the second post end edge of the adjacent corner post, the second post end edge of the corner post longitudinally aligned with the first post end edge of the adjacent corner post and first leg outer wall of the corner post facing the first leg outer wall of the adjacent corner post, the plurality of recessed areas of the corner post are longitudinally aligned with the plurality of ribs of the adjacent corner post and the plurality of ribs of the corner post are longitudinally aligned with the plurality of recessed areas of the adjacent corner post so that the plurality of ribs of the corner post and the plurality of ribs of the adjacent corner post mesh and interlock when the corner post and the adjacent corner post are pressed together.

9. The corner post of claim 8, wherein the recessed area cutout portions extend across a fold line defining an edge of the first leg outer wall such that the plurality of recessed areas extend to a first post leg edge that is opposite the post corner.

10. The corner post of claim 8, wherein, when the corner post blank is folded about the plurality of fold lines for form the corner post, the first corner post leg includes a first leg interior wall disposed between the first leg outer wall and a first leg inner wall that does not include recessed area cutout portions.

11. The corner post of claim 8, comprising a row of first contour cutout portions through the corner post blank that extend across a first fold line between a first leg first wall of the first corner post leg and a second leg first wall of the second corner post leg, wherein the first contour cutout portions are spaced in the longitudinal direction along the first fold line, and wherein, when the corner post blank is folded about the plurality of fold lines to form the corner post, the first contour cutout portions define a plurality of recessed edge contours disposed at the post corner and extending inward from the outer surface of the first corner post leg and an outer surface of the second corner post leg.

12. The corner post of claim 11, comprising a row of second contour cutout portions through the corner post blank that extend across a second fold line between a first leg second wall of the first corner post leg and a second leg second wall of the second corner post leg, wherein the second contour cutout portions are spaced in the longitudinal direction along the second fold line, and wherein, when the corner post blank is folded about the plurality of fold lines to form the corner post, the second contour cutout portions align with the first contour cutout portions to define the plurality of recessed edge contours extending inward from the outer surface of the first corner post leg and the outer surface of the second corner post leg and through the first leg second wall and the second leg second wall, wherein the first corner post leg comprises a first leg interior wall disposed between the first leg inner wall and the first leg outer wall, wherein the second corner post leg comprises a second leg interior wall disposed between the second leg inner wall and the second leg outer wall, and wherein the plurality of recessed edge contours extend inward through the first leg interior wall and the second leg interior wall.

13. A corner post for a plastic film wrapped package for a product, wherein the corner post is fabricated from a paperboard blank, the corner post comprising:

a first corner post leg having a first leg inner wall and a first leg outer wall;

a second corner post leg having a second leg inner wall and a second leg outer wall, wherein the first corner post leg and the second corner post leg intersect at a post corner;

a plurality of recessed edge contours disposed at the post corner and extending inward from an outer surface of the first leg outer wall and an outer surface of the second leg outer wall, wherein the plurality of recessed edge contours are spaced in the longitudinal direction of the corner post;

a plurality of recessed areas extending inward from the outer surface of the first leg outer wall, wherein the plurality of recessed areas are spaced in a longitudinal direction of the corner post to define a plurality of ribs spaced in the longitudinal direction along the first leg outer wall;

a first post end edge at a first longitudinal end of the corner post; and a second post end edge at a second longitudinal end of the corner post that is longitudinally opposite the first longitudinal end, where the plurality of recessed areas and the plurality of ribs are positioned along the first leg outer wall such that, when the corner post is aligned with an adjacent corner post with the first post end edge of the corner post longitudinally aligned with the second post end edge of the adjacent corner post, the second post end edge of the corner post longitudinally aligned with the first post end edge of the adjacent corner post and the first leg outer wall of the corner post facing the first leg outer wall of the adjacent corner post, the plurality of recessed areas of the corner post are longitudinally aligned with the plurality of ribs of the adjacent corner post and the plurality of ribs of the corner post are longitudinally aligned with the plurality of recessed areas of the adjacent corner post so that the plurality of ribs of the corner post and the plurality of ribs of the adjacent corner post mesh and interlock when the corner post and the adjacent corner post are pressed together.

14. The corner post of claim 13, wherein the first corner post leg comprises a first leg interior wall disposed between the first leg inner wall and the first leg outer wall, wherein the second corner post leg comprises a second leg interior wall disposed between the second leg inner wall and the second leg outer wall, and wherein the plurality of recessed edge contours extend inward through the first leg interior wall and the second leg interior wall.

15. The corner post of claim 13, wherein the second leg outer wall is spaced from the second leg inner wall, wherein the second corner post leg comprises a second leg intermediate wall extending between an inner wall edge of the second leg inner wall opposite the post corner and an outer wall edge of the second leg outer wall opposite the post corner to define a second leg cavity.

16. The corner post of claim 15, wherein the second corner post leg comprises a second leg support wall extending from the post corner to an intersection of the second leg inner wall and the second leg intermediate wall.

* * * * *